US006382053B1

(12) United States Patent
Macor

(10) Patent No.: US 6,382,053 B1
(45) **Date of Patent: *May 7, 2002**

(54) WRENCH ORIFICE WITH ENHANCED LONGITUDINAL FRICTION

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/759,439

(22) Filed: Jan. 16, 2001

(51) Int. Cl.[7] ..... B25B 13/06
(52) U.S. Cl. ..... 81/121.1; 81/125
(58) Field of Search ..... 81/121.1, 125, 81/124.3, 124.4, 125.1, 119

(56) References Cited

U.S. PATENT DOCUMENTS 2,834,240 A * 5/1958 Schlichting ..... 81/125
3,253,626 A * 5/1966 Stillwagon, Jr. et al. ..... 81/125
4,644,831 A * 2/1987 Yang ..... 81/125
5,724,872 A * 3/1998 Shih ..... 81/125

* cited by examiner

*Primary Examiner*—Eileen P. Morgan
*Assistant Examiner*—Joni B. Danganan

(57) ABSTRACT

A wrench tool is described which has an orifice with a driving end for turning fasteners. The orifice is substantially cylindrical and comprises an array of longitudinal, engaging surfaces positioned therein forming a symmetrical pattern around an imaginary central axis. At least three of the longitudinal engaging surfaces each have at least a small region thereon roughened, and the roughened, internal engaging surfaces form a pattern around the imaginary central axis. And, each roughened region is formed so as to enhance longitudinal friction between the wrench tool and the fasteners. In some preferred embodiments, there is a predetermined total number of longitudinal engaging surfaces, and the total number of longitudinal engaging surfaces is divisible by six using whole numbers.

20 Claims, 2 Drawing Sheets

WRENCH ORIFICE WITH ENHANCED LONGITUDINAL FRICTION

REFERENCES TO RELATED APPLICATIONS

This application relates to U.S. patent application entitled WRENCH ORIFICE WITH LATERAL GRIPPING GROOVES filed by the inventor herein, of which the application serial number and filing date are not known at the time of this filing.

FIELD OF THE INVENTION

The present invention relates to hand tools, particularly wrenches which have an orifice for turning fasteners, including sockets and box wrenches.

BACKGROUND OF THE INVENTION

When turning a wrench on a fastener, users frequently encounter problems where the wrench slips off the fastener because the wrench has become tilted on the fastener during operation, and/or, the fastener head is eroded or manufactured with a tapered head. These problems are referred to herein as "tilt-off" and "taper-off" effects.

More specifically, applicant defines the "tilt-off" effect as an effect which occurs when a user is turning a fastener (either tightening or loosening) and the wrench becomes slightly tilted on the fastener. When this occurs, the forces involved tend to push the wrench away from and off the fastener often damaging the fastener and/or wrench, and possibly injuring the user. Applicant defines the "taper-off" effect as an effect which occurs when a user is turning a fastener (either tightening or loosening) which is slightly eroded, rusted, and/or manufactured with a slight tapered or conical head. When this occurs, the forces involved also tend to push the wrench away from and off the fastener often damaging the fastener and/or wrench, and possibly injuring the user. Applicant believes that the "tilt-off" and "taper-off" effects defined herein occur easily and frequently because it is difficult for a user to maintain a continuous, properly seated relationship between a wrench and fastener when both are being forcibly turned. Additionally, it is common to encounter a fastener which is slightly eroded, rusted, and/or manufactured with the fastener head slightly tapered or conical.

In the past, there have been many attempts, some successful, to improve the lateral (side-to-side) turning interaction between a wrench and fastener. The prior art addresses the lateral friction between a wrench and fastener, not longitudinal friction. Whereas, lateral friction affects the side-to-side interaction between a wrench and a fastener, and, longitudinal friction affects the up and down or vertical interaction between a wrench and a fastener. The prior art, lateral friction technologies have little or no affect on reducing the effects of "tilt-off" and "taper-off" as defined herein, in fact, they may actually promote the effects of tilt-off and taper-off.

Applicant recognizes that some prior art, lateral friction technologies include internal engaging surfaces that have grooves, however, the grooves are positioned longitudinally or generally parallel to the axis of wrench rotation. Accordingly, grooves positioned generally parallel to the axis of wrench rotation, actually reduce the longitudinal friction between a wrench and a fastener thereby promoting the affects of "tilt-off" and "taper-off," as defined herein. Accordingly, grooves positioned longitudinally (up and down) teach away from, and are in contradiction with, the structure and objectives of the present invention.

SUMMARY OF THE INVENTION

The present invention involves a wrench tool which has an orifice with a driving end for turning fasteners. The orifice is substantially cylindrical and comprises an array of longitudinal, engaging surfaces positioned therein forming a symmetrical pattern around an imaginary central axis. At least three of the longitudinal engaging surfaces each have at least a small region thereon roughened, and the roughened, internal engaging surfaces form a symmetrical pattern around the imaginary central axis. And, each roughened region is formed so as to enhance longitudinal friction between the wrench tool and the fasteners. In some preferred embodiments, there is a predetermined total number of longitudinal engaging surfaces, and the total number of longitudinal engaging surfaces is divisible by six using whole numbers.

Each roughened region promotes longitudinal friction between wrench and fastener thereby reducing the effects of "tilt-off" and/or "taper-off" as defined herein. Importantly, this longitudinal friction technology may be used in conjunction with known lateral friction technologies to provide for a wrench tool with superior lateral and longitudinal gripping performance under torque. In fact, the longitudinal friction technology of the present invention is more effective when used in conjunction with lateral type friction technologies which enhance the surface-to-surface engagement between wrench and fastener.

Accordingly, it is an important objective of the present invention described above to increase the longitudinal or up-and-down friction between a turning wrench and a fastener thereby preventing or significantly reducing the effects of "tilt-off" and/or "taper-off" as defined herein.

It is another objective of the present invention to reduce wrench wear and breakage.

It is yet another objective of the present invention to reduce the potential of injury to a user.

It is yet another objective of the present invention that it be compatible with other known lateral friction technologies so as to provide for a wrench tool with superior lateral and longitudinal gripping performance under torque.

And, it is yet another objective of the present invention that it be commercially viable, simple in design, and cost efficient to manufacture.

DETAILED DESCRIPTION OF THE DRAWINGS

Figure 1:
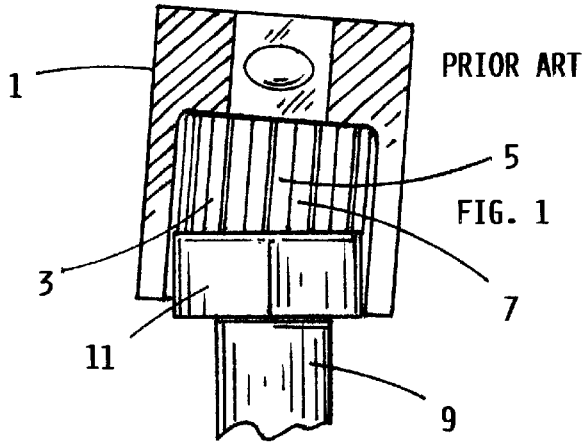
FIG. 1 shows a side cross-section view of a prior art socket and cut section of a bolt, showing a "tilt off" situation occurring between socket and bolt during the application of torque; and, FIG. 2 shows a side, cross-section view of a present invention wrench tool being a socket; and, FIG. 3 shows a top view of the present invention socket shown in FIG. 2; and, FIG. 4 shows a side, cross-section view of another present invention wrench tool being a socket; and, FIG. 5 shows a cut, side cross-section view of a present invention wrench tool being a box type wrench; and, FIG. 6 shows a top view of the present invention box wrench shown in FIG. 5.

Referring now to the drawings which are for the purpose of illustrating preferred embodiments of the present invention and not for the purpose of limiting same, FIG. 1 shows a side, cross-section view of a prior art socket and cut section of a bolt. There is shown wrench socket 1 having an orifice 3 with longitudinal engaging surfaces positioned therein represented by 5 and 7. Socket 1 is a standard type socket which in this case has 24 longitudinal, engaging surfaces, half of which are seen in this side, cross-section view. Prior art socket 1 is applying torque to bolt head 11 of bolt 9, and a tilt-off effect is occurring. Frequently, it is difficult for a user to maintain a continuous, properly seated relationship between a wrench and fastener when both are being forcibly turned. Additionally, it is common to encounter a fastener which is slightly eroded, rusted, and/or manufactured such that the head of the fastener is slightly tapered or conical. Consequently, a user will experience a tilt-off and/or taper-off effect. The "tilt-off" effect is defined herein as an effect which occurs when a user is turning a fastener (either tightening or loosening) and the wrench head becomes slightly tilted on the fastener. When this occurs, the forces involved tend to push the wrench orifice away from and off the fastener often damaging the fastener and/or wrench, and possibly injuring the user. The "taper-off" effect is defined as an effect which occurs when a user is turning a fastener (either tightening or loosening) which is slightly eroded, rusted and/or manufactured with a slight tapered or conical head. When this occurs, the forces involved tend to push the wrench orifice away from and off the fastener often damaging the fastener and/or wrench, and possibly injuring the user. Embodiments of the present invention shown in FIGS. 2 through 6 specifically address and reduce both the tilt-off and taper-off effects as defined herein.

Figure 2:
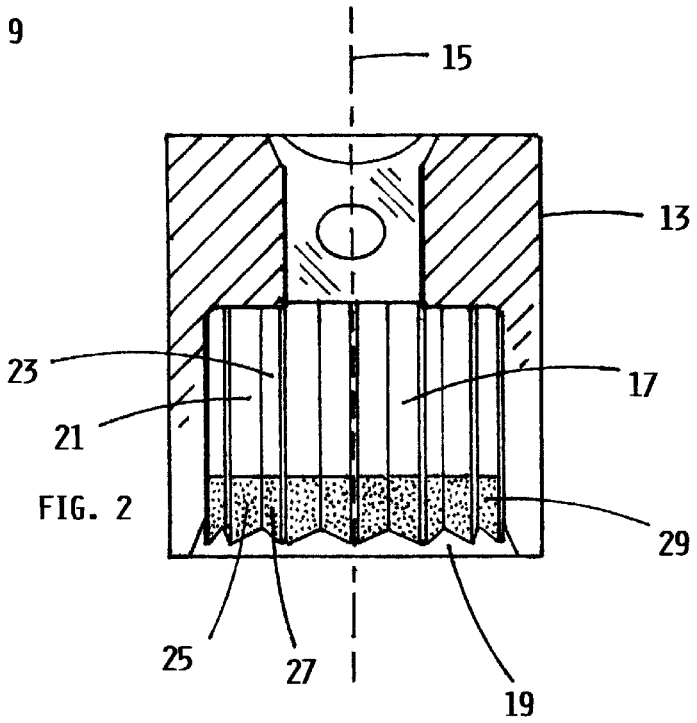
Figure 3:
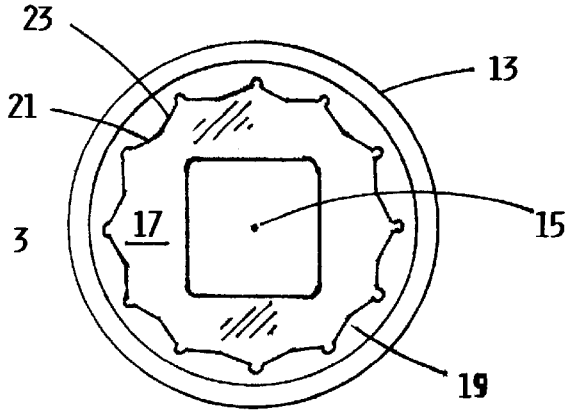

Referring now to FIGS. 2 and 3, FIG. 2 shows a side, cross-section view of a present invention wrench tool being a socket; and, FIG. 3 shows a top view of the same socket shown in FIG. 2 . There is shown a present invention wrench tool 13 which in this embodiment is socket which has an orifice 17. Orifice 17 is substantially cylindrical and has an imaginary central axis 15 and a driving end 19 for engaging with various fasteners. Orifice 17 comprises an array of twenty four, longitudinal engaging surfaces positioned therein around imaginary central axis 15. Two of the twenty four, longitudinal engaging surfaces of this embodiment are represented by engaging surfaces 21 and 23. All twenty four, engaging surfaces are not numbered so as not to crowd the drawing and confuse the comprehension thereof. Accordingly, half of the twenty four, longitudinal engaging surfaces of socket 13 are seen in FIG. 2; and, the ends of all twenty four, longitudinal engaging surfaces are seen in FIG. 3. In this embodiment, and all embodiments of the present invention for that matter, the array of longitudinal engaging surfaces form a symmetrical pattern around an imaginary central axis. Usually, a wrench orifice designed to turn a hexagonal fastener will have between six and twenty four, or possibly more longitudinal engaging surfaces. However, a wrench orifice designed to turn a fastener with a square shaped head may have only four or eight longitudinal engaging surfaces. Accordingly, a present invention wrench tool may have less than twenty four, longitudinal engaging surfaces, but will generally have at least six. A longitudinal engaging surface is defined herein as any surface within an orifice of a wrench tool, which is formed longitudinally and for engagement with a fastener. Preferred embodiments of the present invention will have a predetermined number of longitudinal engaging surfaces, and the number will be divisible by six using whole numbers. In FIGS. 2 and 3, all of the longitudinal engaging surfaces each have at least a small region thereon which is roughened, and the roughened regions are represented by roughened region 27 on engaging surface 23, and roughened region 25 on engaging surface 21. The roughened regions are each formed with a "sand paper" type texture which will tend to hold a fastener longitudinally (up and down), thereby reducing, if not preventing the affects of "tilt off" and "taper-off." The "sand paper" type texture of the roughened regions provides for a coefficient of friction substantially greater than a coefficient of friction created between a smooth engaging surface and a fastener. To maximize the frictional control upon a fastener, all embodiments of the present invention include at least three roughened, longitudinal engaging surfaces which together form a symmetrical a pattern around an imaginary central axis, such as central axis 15. Some preferred embodiments of the present invention will have a predetermined number of roughened, longitudinal engaging surfaces, and the number will be divisible by six using whole numbers. In FIGS. 2 and 3, all of the twenty four, longitudinal engaging surfaces of socket 13 each have a small region thereon roughened, with the roughened regions forming a band 29 inside orifice 17 and around imaginary central axis 15. The band is positioned proximate driving end 19 to maximize the longitudinal friction imparted to a fastener which is slightly eroded, rusted or has a conical shaped head. The roughened regions are each formed specifically to enhance the longitudinal or up-and-down, coefficient of friction between the wrench and a fastener.

Figure 4:
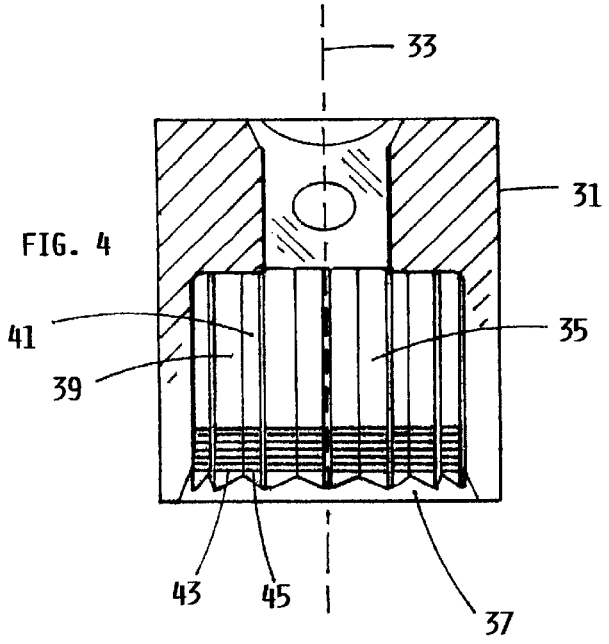

Referring now to FIG. 4, there is shown a side, cross-section view of another present invention wrench tool being a socket. Socket 31 has an orifice 35 with a driving end 37 for turning fasteners. Orifice 35 is substantially cylindrical and includes an array of longitudinal engaging surfaces positioned therein around imaginary central axis 33. The longitudinal, engaging surfaces are represented by engaging surfaces 39 and 41. All the longitudinal engaging surfaces shown in this view are not numbered so as not to crowd the drawing and confuse the comprehension thereof. Socket 31 has a total of twenty four, longitudinal engaging surfaces, of which twelve are seen in this cross-section view. The twenty four, longitudinal engaging surfaces positioned in orifice 35 form a symmetrical pattern around imaginary central axis 33. In some preferred embodiments like socket 31, there is a predetermined total number of longitudinal engaging surfaces, and the total number of longitudinal engaging surfaces is divisible by six using whole numbers. Socket 31 has a total number of twenty four, longitudinal engaging surfaces, and therefore, the total number of engaging surfaces is divisible by six using whole numbers. All of the longitudinal engaging surfaces of socket 31 each have at least a small region thereon roughened to enhance the longitudinal, coefficient of friction between the wrench and a fastener not shown in this view. The roughened regions include laterally positioned micro-grooves, represented by roughened region 43 on engaging surface 39, and roughened region 45 on engaging surface 41. To maximize the frictional control upon a fastener, all embodiments of the present invention include at least three roughened, longitudinal engaging surfaces which together form a symmetrical a pattern around an imaginary central axis, such as central axis 33. Some preferred embodiments of the present invention will have a predetermined number of roughened, longitudinal engaging surfaces, and the number will be divisible by six using whole numbers. Each roughened region is formed so as to enhance the longitudinal, coefficient of friction between the wrench tool and a fastener. The roughened regions or lateral micro-grooves provide for a longitudinal, coefficient of friction substantially greater than a coefficient of friction created between a smooth engaging surface and a fastener. In this embodiment, the micro-grooves are formed substantially perpendicular to imaginary central axis 33 which is also the axis of wrench rotation.

Applicant recognizes the fact that some prior art technologies include internal engaging surfaces that may have grooves, however, the grooves are positioned longitudinally or substantially parallel to the central axis of wrench rotation. When grooves are positioned longitudinally or substantially parallel to the axis of wrench rotation, they actually reduce the longitudinal, coefficient of friction between a wrench and a fastener thereby promoting the affects of "tilt-off" and "taper-off," as defined herein. In fact, grooves positioned longitudinally or generally parallel to the axis of wrench rotation teach away from, and are in contradiction with, the structure and objectives of the present invention. In contradiction to the prior art, some embodiments of the present invention may include micro-grooves positioned laterally or substantially perpendicular to the axis of wrench rotation, and are therefore, formed specifically to enhance the longitudinal, coefficient of friction between a wrench and fastener. Therefore, a "roughened region" is defined herein as any region not being smooth which has been intentionally formed so as to promote and enhance the longitudinal, coefficient of friction between a wrench and a fastener.

Figure 5:
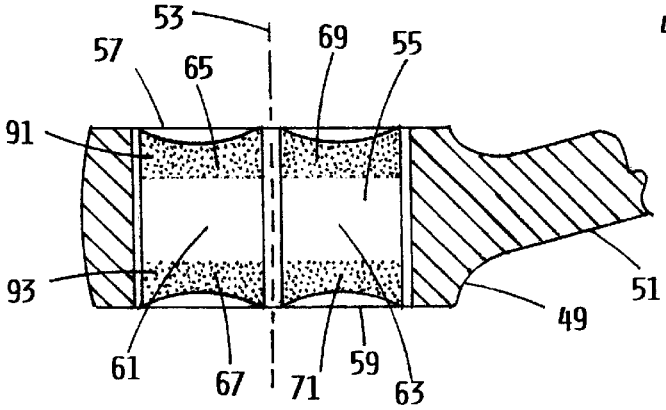
Figure 6:
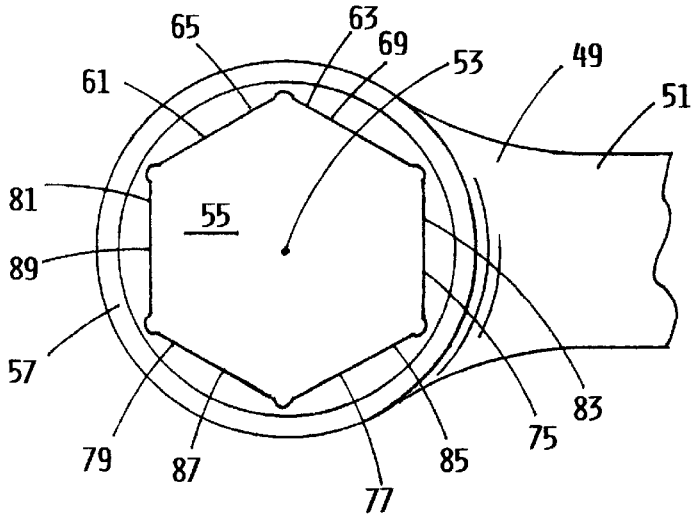

Referring now to FIGS. 5 and 6, FIG. 5 shows a cut, side cross-section view of a present invention wrench tool being a box wrench; and, FIG. 6 shows a top view of the same box wrench shown in FIG. 5. There is shown a present invention wrench tool 49 which in this embodiment is a box type wrench which has a handle 51 and a orifice 55. Orifice 55 is substantially cylindrical and has an imaginary central axis 53 and a driving ends 57 and 59 for engaging with various fasteners. Orifice 55 comprises an array of six, longitudinal engaging surfaces positioned therein around imaginary central axis 53. Two of the six, longitudinal engaging surfaces 61 and 63 of this embodiment are visible in FIG. 5 and all six longitudinal engaging surfaces 61, 63, 75, 77, 79 and 81 are visible in FIG. 6. In this embodiment, and all embodiments of the present invention for that matter, the array of longitudinal engaging surfaces form a symmetrical pattern around an imaginary central axis. Although the "six point" embodiment here has only six longitudinal engaging surfaces, it is also possible to have a "six point" wrench orifice with more than six longitudinal engaging surfaces to increase the lateral engagement and friction between the wrench and a fastener. The longitudinal engaging surfaces may be flat and/or arcuate. Usually, a wrench orifice designed to turn a hexagonal fastener will have between six and twenty four, or possibly more longitudinal engaging surfaces. However, a wrench orifice designed to turn a fastener with a square shaped head may have only four or eight longitudinal engaging surfaces. A present invention wrench tool will generally have at least six longitudinal engaging surfaces. Accordingly, a longitudinal engaging surface is defined herein as any surface within an orifice of a wrench tool, which is formed longitudinally and for engagement with a fastener. Preferred embodiments of the present invention will have a predetermined number of longitudinal engaging surfaces, and the number will be divisible by six using whole numbers. In FIGS. 5 and 6, all of the six longitudinal engaging surfaces each have at least a small region thereon which is roughened. In FIG. 5, it can be seen that each engaging surface has two roughened regions, whereas engaging surface 61 has roughened regions 65 and 67; and, engaging surface 63 has roughened regions 69 and 71. Although not fully seen in these views, all of the longitudinal engaging surfaces each have two roughened regions thereon as seen in FIG. 5. In FIG. 6, engaging surface 61 has roughened region 65; and, engaging surface 63 has roughened region 69; and, engaging surface 75 has roughened region 83; and, engaging surface 79 has roughened region 87; and, engaging surface 81 has roughened region 89. FIG. 6 helps to illustrate that all of the longitudinal engaging surfaces each have a roughened region thereon. The roughened regions are each formed with a "sand paper" type texture which will tend to hold a fastener longitudinally, thereby reducing, if not preventing the affects of tilt off and taper-off. The "sand paper" type texture of the roughened regions provides for a coefficient of friction substantially greater than a coefficient of friction created between a smooth engaging surface and a fastener. Since wrench tool 49 is a box wrench, with two available driving ends 57 and 59, each of the longitudinal engaging surfaces of box wrench 49 are provided with two, roughened regions to accommodate the two driving ends. An alternative, would be to simply form the entire engaging surface with a "sand paper" type texture. In any event, it is important that the roughened regions are positioned proximate each driving end so as to fully minimize or prevent the effects of taper-off as defined herein. To maximize the frictional control upon a fastener, all embodiments of the present invention include at least three roughened, longitudinal engaging surfaces which together form a symmetrical pattern around an imaginary central axis, such as central axis 53. Some preferred embodiments of the present invention will have a predetermined number of roughened, longitudinal engaging surfaces, and the number will be divisible by six using whole numbers. In FIGS. 5 and 6, all of the six, longitudinal engaging surfaces of box wrench 49 each have two, regions thereon roughened, with the roughened regions forming two separate bands 91 and 93 (seen in FIG. 5 only) inside orifice 55 and around imaginary central axis 53. The roughened regions are each formed so as to enhance the longitudinal or up-and-down, coefficient of friction between the wrench and a fastener.

Upon reading and understanding the specification of the present invention describe above, modifications and alterations will become apparent to those skilled in the art. It is intended that all such modifications and alterations be included insofar as they come within the scope of the patent as claimed or the equivalence thereof.

Having thus described the invention, the following is claimed:

1. A wrench tool having an orifice with a driving end for turning fasteners, said orifice comprising means to reduce tilting of a fastener therein while being torqued, said orifice being substantially cylindrical and comprising an array of longitudinal engaging surfaces positioned therein forming a symmetrical pattern around an imaginary central axis; said means to reduce tilting comprising at least three of said longitudinal engaging surfaces each having at least a small region thereon roughened, said roughened, internal engaging surfaces forming a pattern around said imaginary central axis, and further whereas, each said roughened region being formed so as to enhance the longitudinal, coefficient of friction between said wrench tool and said fasteners.

2. A wrench tool of claim 1, wherein said orifice comprises a predetermined total number of longitudinal engaging surfaces, and the total number of longitudinal engaging surfaces is divisible by six using whole numbers.

3. A wrench tool of claim 1, wherein there is a predetermined number of roughened, longitudinal engaging surfaces, and the number of roughened, longitudinal engaging surfaces is divisible by six using whole numbers.

4. A wrench orifice of claim 1, wherein all of said longitudinal engaging surfaces each have at least a small region thereon roughened to enhance the longitudinal, coefficient of friction between said wrench tool and said fasteners.

5. A wrench of claim 4, wherein the roughened regions of said longitudinal engaging surfaces substantially form a band inside said orifice and around said imaginary central axis, said band being positioned proximate a driving end of said orifice.

6. A wrench tool of claim 1, wherein said wrench tool is a socket.

7. A wrench tool of claim 1, wherein said wrench tool is a box wrench.

8. A wrench orifice of claim 1, wherein each said roughened region comprises a number of grooves, and each said groove is formed being substantially perpendicular to said imaginary central axis.

9. A wrench tool having an orifice with a driving end for turning fasteners, said orifice comprising means to reduce tilting of a fastener therein while being torqued, said orifice being substantially cylindrical and comprising an array of at least six longitudinal engaging surfaces positioned therein forming a symmetrical pattern around an imaginary central axis; said means to reduce tilting comprising at least six of said longitudinal engaging surfaces each having at least a small region thereon roughened, said roughened, internal engaging surfaces forming a symmetrical pattern around said imaginary central axis, and further whereas, each said roughened region being formed so as to enhance the longitudinal, coefficient of friction between said wrench tool and said fasteners.

10. A wrench tool of claim 9, wherein said orifice comprises a predetermined total number of longitudinal engaging surfaces, and the total number of longitudinal engaging surfaces is divisible by six using whole numbers.

11. A wrench tool of claim 10, wherein said wrench tool is a socket.

12. A wrench tool of claim 10, wherein said wrench tool is a box wrench.

13. A wrench tool of claim 9, wherein there is a predetermined number of roughened, longitudinal engaging surfaces, and the number of roughened, longitudinal engaging surfaces is divisible by six using whole numbers.

14. A wrench tool of claim 13, wherein said wrench tool is a socket.

15. A wrench tool of claim 13, wherein said wrench tool is a box wrench.

16. A wrench orifice of claim 9, wherein all of said longitudinal engaging surfaces each have at least a small region thereon roughened to enhance the longitudinal, coefficient of friction between said wrench tool and said fastener.

17. A wrench of claim 16, wherein the roughened regions of said longitudinal engaging surfaces substantially form a band inside said orifice and around said imaginary central axis, said band being positioned proximate a driving end of said orifice.

18. A wrench tool of claim 9, wherein said wrench tool is a socket.

19. A wrench tool of claim 9, wherein said wrench tool is a box wrench.

20. A wrench tool having an orifice with a driving end for turning fasteners, said orifice comprising means to reduce tilting of a fastener therein while being torqued, said orifice being substantially cylindrical and comprising a predetermined total number of longitudinal engaging surfaces positioned therein forming a symmetrical pattern around an imaginary central axis, said total number of longitudinal engaging surfaces being divisible by six in whole numbers; said means to reduce tilting comprising all of said longitudinal engaging surfaces each having at least a small region thereon roughened, said roughened regions of said longitudinal engaging surfaces substantially forming a band inside said orifice and around said imaginary central axis, said band being positioned proximate a driving end of said orifice, and further whereas, each said roughened region being formed so as to enhance the longitudinal, coefficient of friction between said wrench tool and said fasteners.

* * * * *